US009953795B2

(12) United States Patent
Kester et al.

(10) Patent No.: US 9,953,795 B2
(45) Date of Patent: Apr. 24, 2018

(54) FUSE CUTOUT INSULATOR

(71) Applicant: Hubbell Incorporated, Shelton, CT (US)

(72) Inventors: Jeffery Joseph Kester, Chippewa Lake, OH (US); Lloyd Ronald Beard, Centralia, MO (US); Sterlin Cochran, McCalla, AL (US); Bryant Haines, Birmingham, AL (US); Charles Worthington, Birmingham, AL (US)

(73) Assignee: Hubbell Incorporated, Shelton, CT (US)

( * ) Notice: Subject to any disclaimer, the term of this patent is extended or adjusted under 35 U.S.C. 154(b) by 556 days.

(21) Appl. No.: 14/330,389

(22) Filed: Jul. 14, 2014

(65) Prior Publication Data

US 2016/0013004 A1 Jan. 14, 2016

(51) Int. Cl.

| | |
|---|---|
| ***H01H 69/02*** | (2006.01) |
| ***H01H 85/20*** | (2006.01) |
| *H01H 85/00* | (2006.01) |
| *H01H 31/12* | (2006.01) |

(52) U.S. Cl.

CPC ..... *H01H 85/2045* (2013.01); *H01H 31/127* (2013.01); *H01H 69/02* (2013.01); *H01H 31/122* (2013.01); *H01H 2085/0034* (2013.01)

(58) Field of Classification Search

CPC ..... H01H 31/127; H01H 85/2045; H01H 2085/0034; H01H 31/122; H01H 31/125; H01H 69/02; H01H 85/22; H01H 85/485

USPC ..... 337/168, 202

See application file for complete search history.

(56) References Cited

U.S. PATENT DOCUMENTS

| | | | | |
|---|---|---|---|---|
| 2,321,827 A | | 6/1943 | Kyle | |
| 2,606,954 A | * | 8/1952 | Baker | H01B 17/18 174/158 R |
| 2,630,508 A | * | 3/1953 | Meisenheimer | H01H 31/125 337/157 |
| 2,821,568 A | * | 1/1958 | Smith, Jr. | H01H 31/125 174/138 R |
| 2,961,518 A | * | 11/1960 | Hermann | H01H 31/127 174/137 B |
| 3,475,546 A | * | 10/1969 | Sadler | H01B 3/006 174/137 B |

(Continued)

OTHER PUBLICATIONS

PCT/US2015/040274 International Search Report and Written Opinion dated Dec. 8, 2015.

*Primary Examiner* — Anatoly Vortman
*Assistant Examiner* — Jacob Crum
(74) *Attorney, Agent, or Firm* — Michael Best & Friedrich, LLP

(57) ABSTRACT

A fuse cutout insulator for use in power distribution systems includes three electrically conductive pieces spaced apart and encapsulated by a dielectric material. The conductive components include a top hood, bottom pin, and central pin. The central pin is generally tube shaped and includes an outwardly extending flange to facilitate attachment of the fuse cutout to a utility pole. The top hood and bottom hinge include the traditional components for operable holding of a fuse tube member. The top hood and bottom hinge are accepted in opposite ends of the central pins bore and sealed in spaced relationship during manufacturing by the dielectric material added for fabricating the weathersheds.

14 Claims, 5 Drawing Sheets

(56) References Cited

U.S. PATENT DOCUMENTS

| | | | | |
|---|---|---|---|---|
| 4,296,276 | A * | 10/1981 | Ishihara | H01B 17/40 174/179 |
| 5,233,132 | A * | 8/1993 | Soucille | H01B 17/325 156/165 |
| 5,300,912 | A * | 4/1994 | Tillery | H01H 31/127 174/179 |
| 8,772,633 | B2 | 7/2014 | Behnken | |
| 2002/0158745 | A1 * | 10/2002 | Haynam | H01H 31/023 337/171 |
| 2004/0184210 | A1 * | 9/2004 | Lynch | H01H 31/006 361/104 |
| 2004/0185944 | A1 * | 9/2004 | Barron | F16D 3/64 464/147 |
| 2005/0280496 | A1 | 12/2005 | Almgren et al. | |
| 2009/0075004 | A1 | 3/2009 | Starita | |

* cited by examiner

FUSE CUTOUT INSULATOR

FIELD OF THE INVENTION

The present invention relates to fuse cutouts for power distribution systems. More particularly, the present invention relates to an insulator for fuse cutouts having three separate conductive components that are electrically separated from one another and encapsulated by insulative material.

BACKGROUND OF THE INVENTION

Fuse cutouts are known in the art. In electrical distribution systems, a fuse cutout is a combination of a fuse and a switch found primarily in overhead feeder lines to protect distribution circuits and transformers from current surges and overloads. An overcurrent caused by a fault in the transformer or customer circuit will cause the fuse to melt, disconnecting the transformer from the line. To facilitate disconnection, cutouts are typically mounted about 20 degrees off vertical so that the center of gravity of the fuse holder is displaced and the fuse holder will rotate and fall open under its own weight when the fuse blows. Mechanical tension on the fuse link normally holds an ejector spring in a stable position. When the fuse blows, the released spring pulls the stub of the fuse link out of the fuse holder tube to reduce surge duration and damage to the transformer and fuse holder to quench any arc in the fuse holder. The cutout can also be opened manually by utility linemen standing on the ground and using a long insulating stick called a "hot stick". If equipped with appropriate mechanisms, cutouts can act as sectionalizers, used on each distribution line downstream from autoreclosing circuit breakers. Autoreclosers sense and briefly interrupt fault currents, and then automatically reclose to restore service. Meanwhile, downstream sectionalizers automatically count current interruptions by the recloser. When a sectionalizer detects a preset number of interruptions of fault current (typically 3 or 4) the sectionalizer opens (while unenergized) and remains open, and the recloser restores supply to the other non-fault sections.

A fuse cutout comprises three major components. The first component is the cutout insulator body, a generally open "C"-shaped frame that includes a conductive top hood piece and a conductive bottom hinge pieces which cooperate to accept a fuse holder as well as a ribbed porcelain or polymer insulator main portion that electrically isolates the conductive portions from the support bracket to which the insulator is fastened via a centrally extending mounting flange. The second component is the fuse holder itself, also called the "fuse tube", that is an insulating tube which contains the replaceable fuse element. When the fuse element operates ("melts"), the fuse holder subsequently drops out of the upper contact of the top hood of the insulator body, breaking the circuit, and hangs from a hinge on its lower end that cooperates with the bottom hinge of the insulator body via a pinion. The hanging fuse holder provides a visible indication that the fuse has operated and assurance that the circuit is open. The circuit can also be opened manually by pulling out the fuse holder using a hot stick with approved load break device. The third component is the fuse element, or "fuse link", which is the replaceable portion of the cutout assembly that operates when the electrical current is great enough. In operation, after the fuse link has blown and the fuse holder drops, a lineman replaces the fuse link and re-deploys the fuse tube in its operating condition between the conductive top hood and bottom hinge pieces of the fuse cutout insulator body.

Today, two types of prior art cutout insulator bodies are used in the field: porcelain and polymer. Porcelain cutout bodies are configured by taking a solid piece of porcelain and boring three holes in the porcelain to accept metal pins that are then used to hold the metal pieces (e.g., top hood, bottom hinge, and central mounting flange) of the cutout in their proper position. A sealing agent, such as sulpher-based cement or similar known material is used to hold and seal the body. The porcelain-based cutout suffers from the drawback of a limited lifespan due to aging problems characterized by the porcelain being compromised and necessitating replacement. This problem is exacerbated in northern climates where the hot and cold seasons result in concomitant expansion and contraction of the component materials which, especially in the presence of moisture, may lead to cracked or punctured porcelain.

A more recent design in the art makes use of polymer cutouts. As will be appreciated, in traditional polymer cutouts, a fiberglass rod is used as a base material to which the metal pieces of the cutout are crimped into place. Injection molding is then used to mold weathersheds around the rod assembly and seal the insulator body. The cost of the material (and price differential) detracts from their deployment in many circumstances. In addition, some polymer cutouts may have their own potential drawbacks, particularly, resulting from interface flaws inevitable with the mass production of injection molded products. With polymer cutouts, the interface flaws result in "tracking"—wherein the dielectric material and carbon-tracking rise to a point of "flash over"—resulting in a short circuit of the device.

The foregoing underscores some of the problems with conventional fuse cutouts.

SUMMARY OF THE INVENTION

Various embodiments of the present invention overcome various of the aforementioned and other disadvantages associated with prior art fuse cutouts and offers new advantages as well. The present invention is based, in part, on the discovery that changing the field stresses of cutout insulators in a way deemed negative results in the surprising and unexpected phenomena of providing a superior fuse cutout. A fuse cutout comprises three separate conductive components encapsulated by a dielectric material. This fuse cutout results in the creation of a set of capacitors within the cutout that withstands the shielding encountered in the operation of the cutout by allowing the stress to pass through the material. In addition, the configuration of various embodiments remove moisture as a problem because the substituent components of the cutout are conductive and are not attached to a fiberglass backbone as they are in prior art polymer cutouts.

According to one aspect of various embodiments there is provided a fuse cutout insulator comprising three conductive pieces electrically isolated form one another and encapsulated in a dielectric material.

In accordance with this aspect, in various embodiments the conductive pieces comprise a central pin, a top hood, and a bottom hinge. Preferably, the central pin includes the mounting flange that serves to connect the cutout to the crossarm bracket of the utility pole, the top hood is associated with the hardware for engaging the top of the fuse tube, and the bottom hinge is associated with the hardware for cooperative arrangement with the pinion and flange of the fuse tube.

In a presently preferred embodiment, the central pin includes a central bore receiving the hood stem and hinge stem members in an electrically isolated manner. Preferably, hood stem and hinge stem members have a generally "C"-shaped cross-section sized to fit spaced apart from the interior walls of the central pin.

The parts may be kept apart by fixture in tooling by known methods such as those used in cast epoxy methods. The voids between the component parts are then filled with a suitable dielectric material. Suitable dielectric materials include preferable materials such as high dielectric plastics, including HDPE or PPE resin sold under the tradename NORYL®. Preferably, the encapsulating or molding process is also used to make the weathersheds of the cutout body.

The formation of a pair of capacitors allows for the stress to pass through the body, thereby overcoming problems encountered with prior art fuse cutouts.

The drawings are for illustration purposes only and are not drawn to scale unless otherwise indicated. The drawings are not intended to limit the scope of the invention.

BRIEF DESCRIPTION OF THE DRAWINGS

Various aspects and advantageous features of the present invention will become more apparent in the detailed description of a preferred embodiment and reference to the accompany drawing wherein.

DETAILED DESCRIPTION OF THE PREFERRED EMBODIMENT

Figure 1:
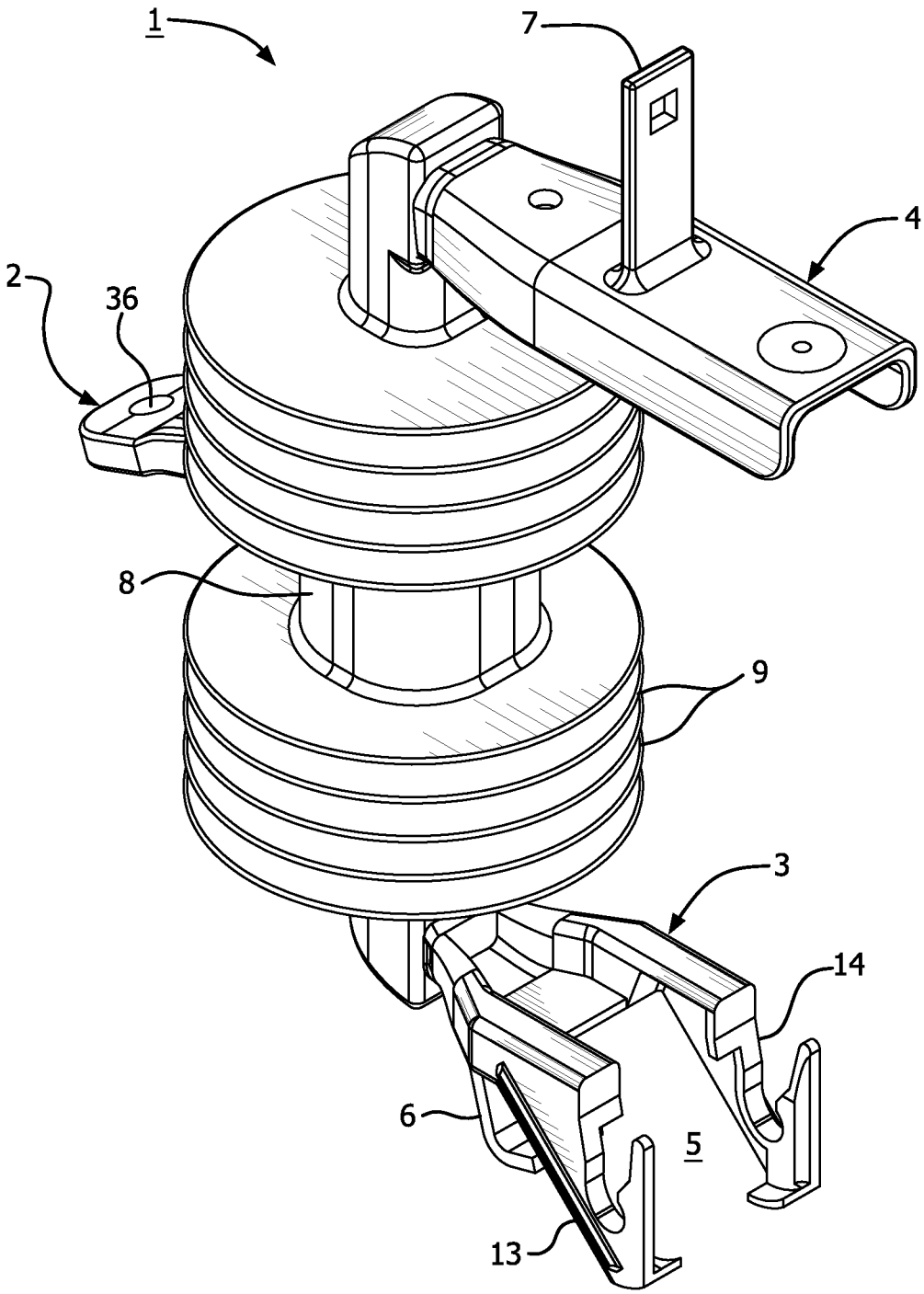
FIG. 1 is a perspective view of an embodiment of a fuse cutout insulator.
Figure 2:
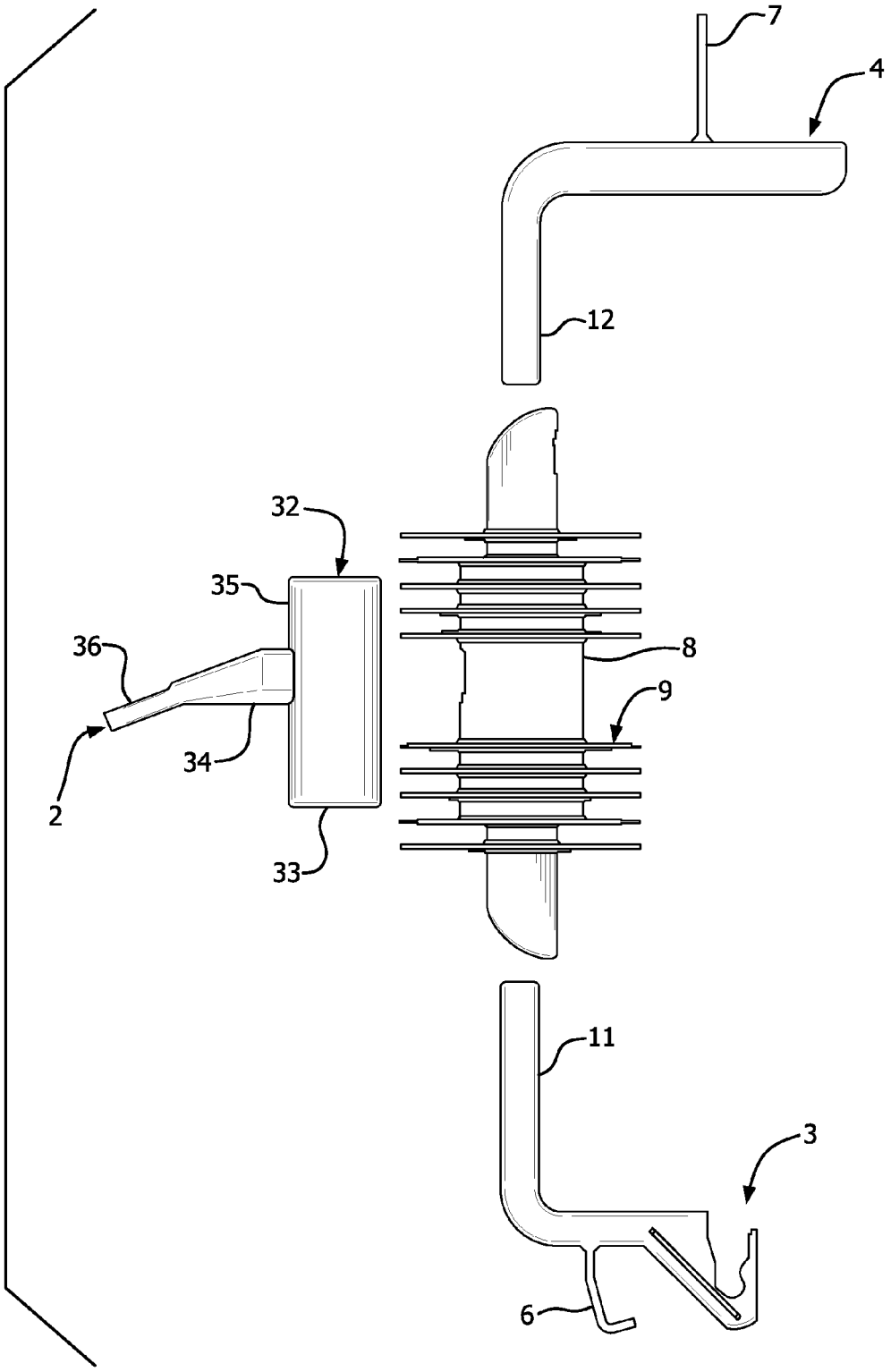
FIG. 2 depicts an exploded side elevational view of the constituent metal components of the fuse cutout of FIG. 1.

While the present invention will be described in connection with a fuse cutout insulator and related components for a power distribution system, it will be readily apparent to one of ordinary skill in the art armed with the present specification that the present invention can be applied to a multiplicity of fields and uses. In particular, the present invention may find use in connection with a power fuse or a sectionalizer. Likewise, the present invention may be advantageous when coupling with a conductive blade to form an airbreak switch or used to hold other circuit make/break and sensing devices. Finally, one of ordinary skill in the art armed with the present specification will also understand that the present system may be easily modified to include different configurations, mechanisms, methods, and kits, which achieve some or all of the purposes of the present invention.

Turning to the Figures, an exemplary fuse cutout insulator body 1 is depicted according to a presently preferred embodiment of the invention. As depicted, the fuse cutout insulator 1 includes three conductive components on which the insulator is injection molded. The three components are the center pin 2, a hinge 3, and a hood 4. The hinge 3 and the hood 4 are received by the center pin 2 and maintained in an electrically isolated assembly. The body 8 of the insulator is injection molded around the assembled center pin 2, hinge 3 and hood 4. As shown, the center pin 2, the hinge 3 and the hood 4 are preferably in an overlapping, spaced relationship, thereby electrically separating each of the components. The spaces, or gaps, between each of the three components are filled with a dielectric material 10 during the injection molding of an insulator body 8.

Preferably, the insulator is made of thermal plastic, such as high-density polyethylene (HDPE) or PPE resin sold under the tradename NORYL®. or a thermal set material, such as epoxy or vinyl ester, but any suitable material can be used. The injection molding material can include reinforcing fillers to enhance properties of the insulator body 8, such as, but not limited to, hydrophobic properties, UV stability, and track resistance. The conductive backbone replaces insulating backbones, conventionally made of porcelain or pultruded fiberglass.

The center pin 2 provides a mechanical connection to a crossarm bracket (not shown) for attachment of the cutout to the utility pole. The hinge 3 extends downwardly from the center pin 2, and the hood 4 extends upwardly from the center pin 2. The hinge 3 and the hood 4 provide a mechanical connection to bottom and top hardware, respectively.

As depicted, in this embodiment, the center pin 2 has a bore 31 passing therethrough. An upper end 32 of the bore 31 receives the stem of the hood 4, and a lower end 33 of the bore receives the stem of the hinge 3. A mounting bracket 34 extends outwardly from a body 35 of the center pin 2 and has an opening 36 therein to facilitate connecting the insulator 1 to a support. An upper surface 37 of the bracket 34 angles downwardly with respect to the body 35. Preferably, an angle of approximately 20 degrees is formed between the upper surface 37 of the bracket 34 and a line perpendicular to a longitudinal axis of the body 35 to allow the assembled cutout to hang at the operative angle from the utility pole when deployed. The mounting bracket 34 preferably has a substantially C-shaped cross section.

The hinge 3 receives a cutout fuse holder assembly and terminations for the electrical conductors. In a presently preferred embodiment, the fuse cutout insulator of the present invention may be configured for use with embodiments of the cutout fuse holder assembly described in co-pending U.S. Application No. TBD filed this same day by the present inventors and entitled "FUSE TUBE," the entire contents of which are hereby incorporated by reference in their entirety. A pocket 5 in the hinge 3 receives a trunnion of the fuse holder assembly. The pocket 5 is formed between first and second arms 13 and 14, which are preferably substantially identical. A termination member 6 receives conductors as will be appreciated by one of ordinary skill in the art.

The hood 4 is preferably a one-piece die cast member. A termination member 7 receives conductors as will be appreciated by one of ordinary skill in the art.

Figure 3:
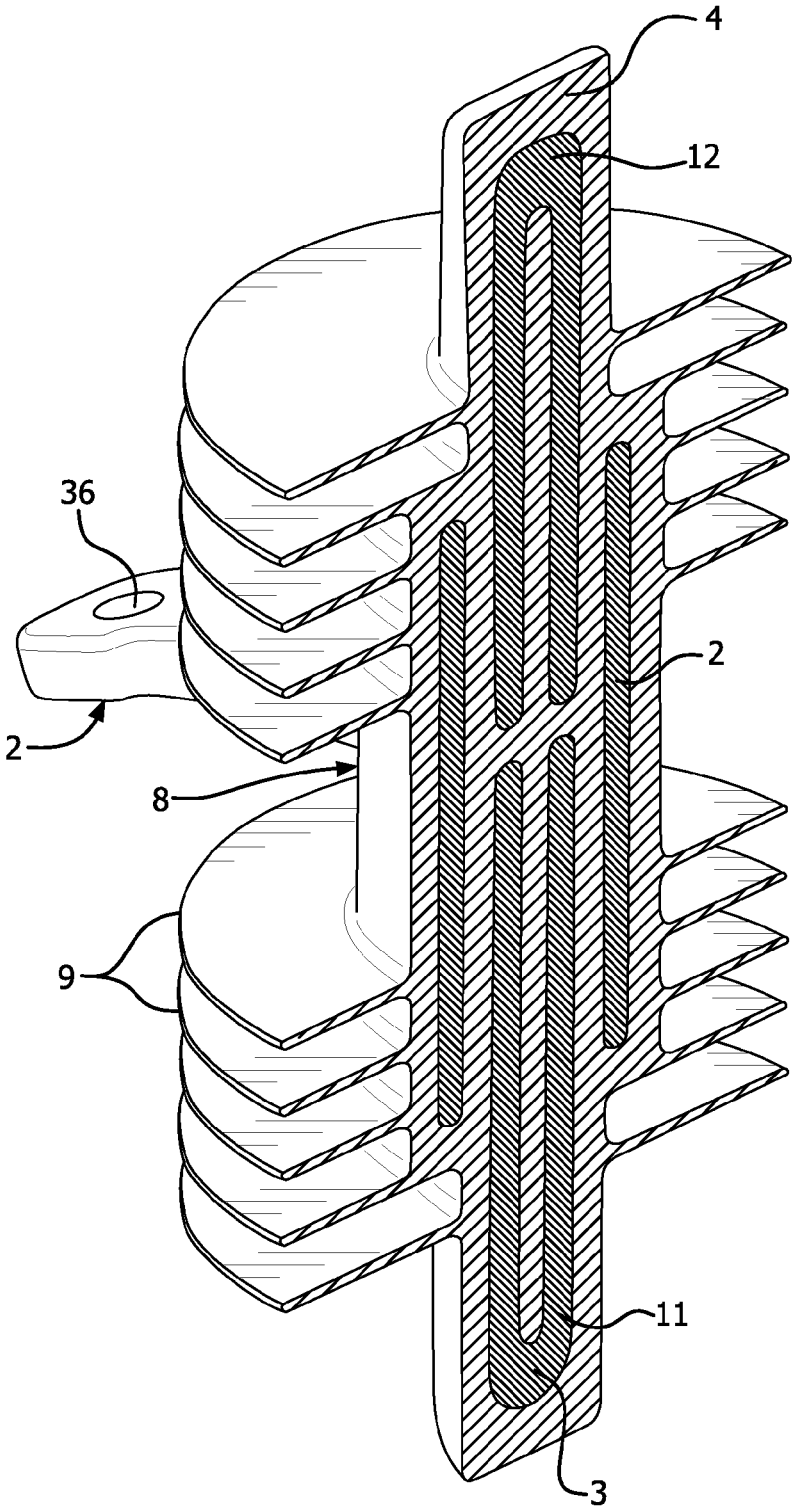
FIG. 3 is a perspective view in section of the fuse cutout insulator of FIG. 1.
Figure 4:
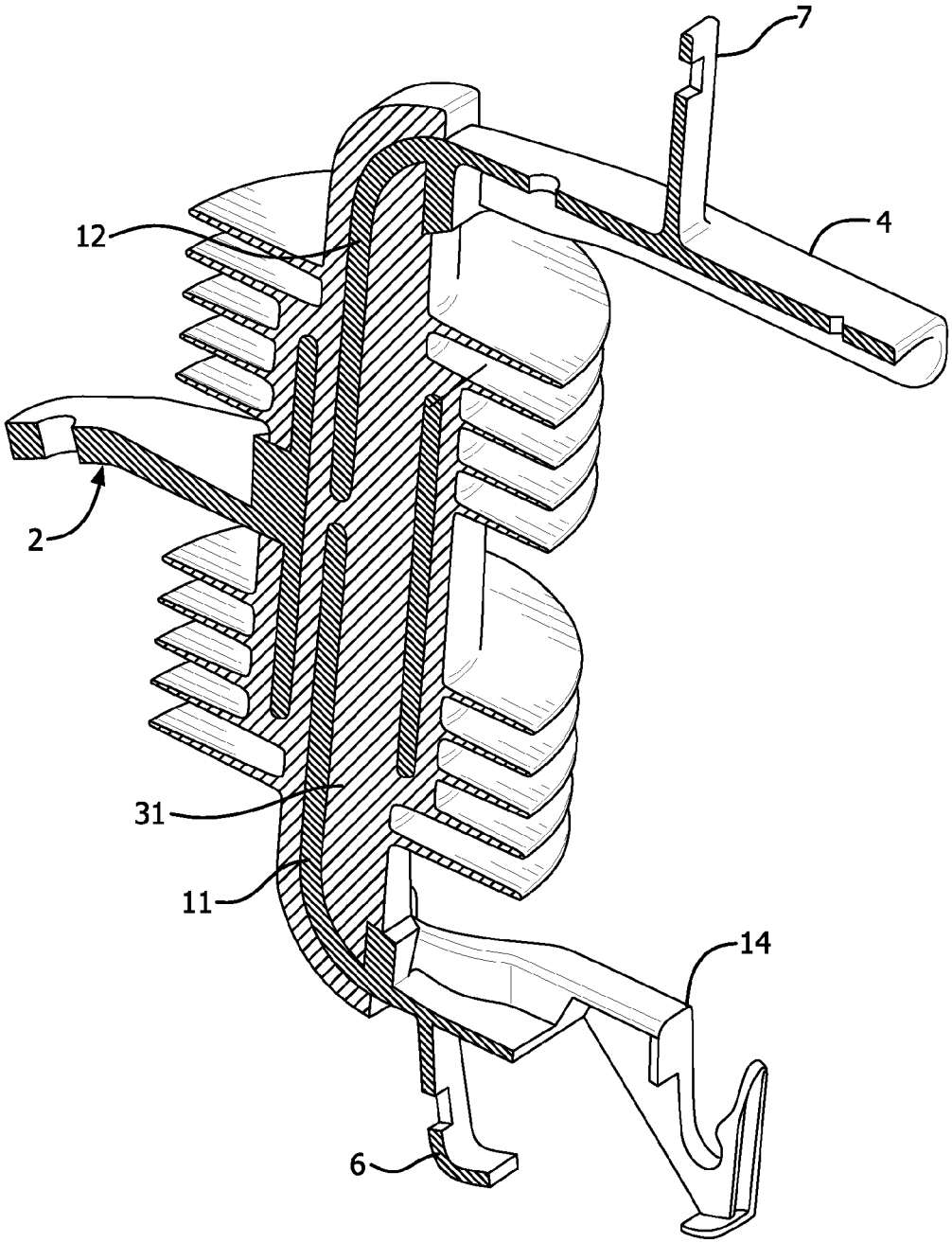
FIG. 4 is a perspective view in section of the assembled fuse cutout insulator of FIG. 1 showing the spaced apart arrangement of the central pin, bottom hinge, and top hood.
Figure 5:
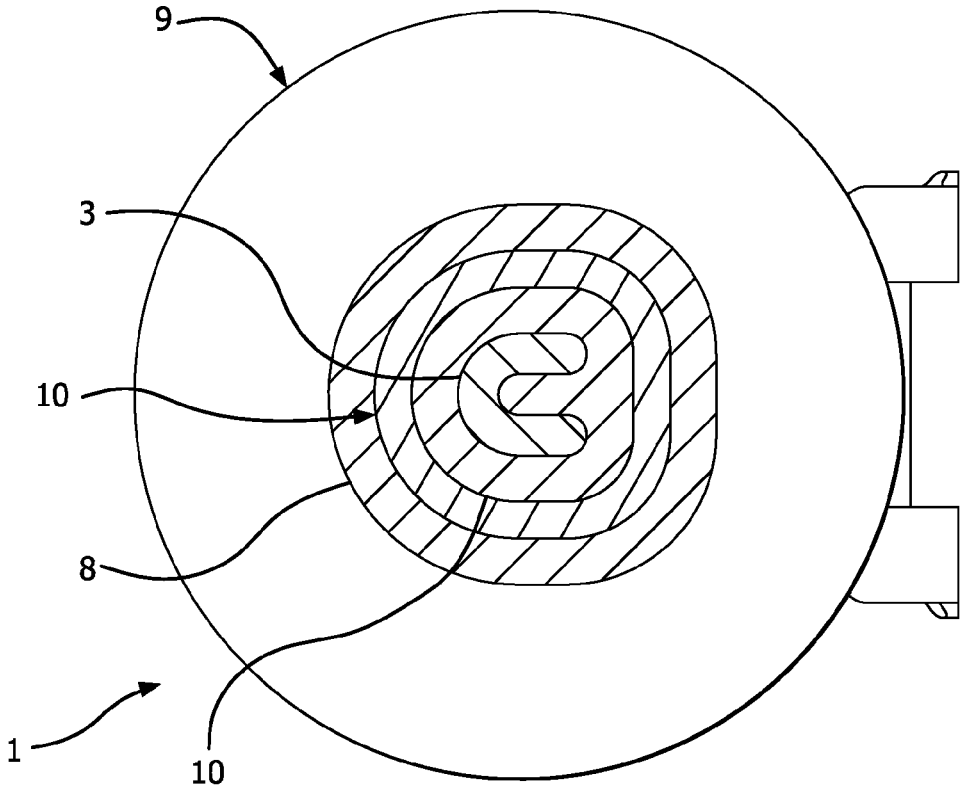
FIG. 5 is a mend view in section of a fuse cutout insulator of FIG. 1 showing the spaced apart arrangement between the central pin and the c-shaped stem of the top hood and hinge members.

The insulator body 8 includes a plurality of weathersheds 9 extending radially outwardly from a central axis. As shown in FIGS. 3 and 4, connecting members 11 and 12 of the hinge 3 and hood 4 are preferably aligned within the center pin 2. The connecting members 11 and 12 are preferably substantially C-shaped in cross section. The bore 31 of the center pin 2 receives the connecting members 11 and 12 as shown in FIG. 5, such that gaps, or spaces, are formed between the connecting members 11 and 12 and the center pin 2. Accordingly, there is space between the inner surface of the bore 31 and the connecting members 11 and 12, and there is space between the ends of the connecting members 11 and 12. These spaces are subsequently filled with a dielectric material 10 during assembly to create a set of capacitors between the conductive components. In operation, the metal pieces are held spaced apart and during molding of the weathersheds, the dielectric material fills the voids thereby creating the assembled cutout insulator.

One of ordinary skill will appreciate that the exact dimensions and materials are not critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters to adjust for carrying out the present invention.

The above embodiments are for illustrative purposes and are not intended to limit the scope of the invention or the adaptation of the features described herein to particular fuse holders. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

We claim:

1. A fuse cutout insulator for a power distribution system comprising:

a tubular, electrically conductive center pin having a central bore;

a hinge having a stem portion extending into the central bore of said center pin from a first direction, said hinge stem portion not being in direct physical contact with said center pin;

a hood having a stem portion extending into the central bore of said center pin from a second direction, said hood stem portion not being in direct physical contact with said center pin; and a dielectric material; wherein said hinge and said hood stem portions are received by said center pin and maintained in an electrically isolated assembly by said dielectric material filling voids between said center pin, hinge, and hood.

2. The fuse cutout insulator of claim 1, wherein said dielectric material is injection molded around said center pin, hinge, and hood when assembled together.

3. The fuse cutout insulator of claim 2, wherein a plurality of weathersheds are formed from said dielectric material.

4. The fuse cutout insulator of claim 3, wherein said dielectric material comprises HDPE or a PPE resin.

5. The fuse cutout insulator of claim 1, wherein said center pin provides a mechanical connection to a crossarm bracket for attachment to a utility pole.

6. The fuse cutout insulator of claim 1, wherein said hinge extends downwardly from said center pin and said hood extends upwardly from the center pin, wherein said hinge and said hood provide a mechanical connection to bottom and top hardware for connection to an electrical distribution system.

7. The fuse cutout insulator of claim 1, wherein said stem portion of at least one of said hinge and hood comprises a generally C-shaped cross section.

8. The fuse cutout insulator of claim 1, wherein said hood and said hinge hold a fuse tube assembly.

9. A fuse cutout insulator comprising:

a metallic backbone including a top hood and a bottom hinge electrically isolated from one another; and a tubular, electrically conductive central pin;

said top hood and bottom hinge having respective stem portions extending toward one another into a central bore of said central pin but not being in direct physical contact with said central pin, and a molded body partially surrounding said central pin, said molded body receiving at least a portion of said top hood and said bottom hinge, said molded body comprising a dielectric material;

wherein said central pin, said top hood, and said bottom hinge are spaced apart from one another to form voids, said voids being filled by said dielectric material.

10. The fuse cutout insulator of claim 9, wherein a plurality of weathersheds are integral with said molded body.

11. The fuse cutout insulator of claim 9, wherein said molded body comprises HDPE or PPE resin.

12. The fuse cutout insulator of claim 9, wherein said hinge includes a termination member for electrical conductors and includes a pocket for a trunnion.

13. The fuse cutout insulator of claim 9, wherein said hinge and said hood include terminations for electrical conductors.

14. The fuse cutout insulator of claim 9, wherein said molded body is molded around said central pin and said portions of said hinge and hood received in said central bore of said central pin.

* * * * *